United States Patent [19]

Baker

[11] 4,344,621

[45] Aug. 17, 1982

[54] TARGET WITH ENERGY-ABSORBING FOAM MAT

[75] Inventor: David E. Baker, Zionsville, Ind.

[73] Assignee: E-A-R Corporation, Indianapolis, Ind.

[21] Appl. No.: 126,341

[22] Filed: Mar. 3, 1980

[51] Int. Cl.[3] ..... A63B 69/40

[52] U.S. Cl. ..... 273/26 A; 273/29 A; 273/1 B; 273/378

[58] Field of Search ..... 273/26 A, 29 A, 176 B, 273/181 R, 181 G, 181 J, 181 K, 182 R, 317, 331, 333, 348, 407, DIG. 5, 1 B, 378, 386, 387

[56] References Cited

U.S. PATENT DOCUMENTS

| | | | |
|---|---|---|---|
| 1,511,430 | 10/1924 | Schonberg | 273/26 A |
| 1,567,384 | 12/1925 | Rectenwald et al. | 273/26 A |
| 2,059,365 | 11/1936 | King | 273/26 A |
| 3,516,675 | 6/1970 | Kuester et al. | 273/181 K |
| 3,810,616 | 5/1974 | Murphy | 273/26 A |
| 3,887,181 | 6/1975 | Samaras | 273/1 B |
| 4,093,218 | 6/1978 | Burchers | 273/29 A |
| 4,173,337 | 11/1979 | Okonowski | 273/26 A |

*Primary Examiner*—Richard C. Pinkham
*Assistant Examiner*—T. Brown
*Attorney, Agent, or Firm*—Jack Schuman; Robert F. Dropkin

[57] ABSTRACT

A practice device for use in the practice of those sports involving the hurling or striking of a ball or other sport projectile toward a specified target. The device of the invention serves to safely arrest the flight of the projectile while informing the user of the exact point of impact of the projectile relative to a defined target zone. The target is a polymeric foam mat having a polymeric sheet bonded to its front face. The sheet removably carries target indicia. Apertures through the foam mat make up 40 to 50 percent of the total surface area of the mat. When a projectile strikes the sheet, an indentation, which lasts from 5 to 60 seconds, indicates the point of impact.

12 Claims, 4 Drawing Figures

TARGET WITH ENERGY-ABSORBING FOAM MAT

BACKGROUND OF THE INVENTION

The present invention relates generally to sporting goods and is more particularly concerned with a practice device for use in those sports in which a sport projectile is hurled or struck toward a specified target zone.

In many sports, such as in softball; baseball; ice, field or street hockey; golf; squash; tennis; paddleball; handball and the like it is an object of the game, during the course of play, to hurl or strike a sport projectile of substantial mass toward a specified target zone. Competency is normally improved by way of individual practice wherein the player repetitively hurls or strikes the sport projectile toward the specific target zone. Thus it is that a baseball pitcher will attempt to perfect his or her art by repetitively pitching to a specific target or "spot" within the strike zone. In ice hockey a player will often spend many hours improving the accuracy of his repertoire of shots from a multitude of the possible shot angles involved in the sport. Likewise, a tennis or golf buff will often spend considerable hours of practice not only in an attempt to perfect the various strokes of the game, per se, but also to deliver his or her shots with increasing accuracy to specified target zones.

Unfortunately, practice of many of these sports has heretofore required substantial space and has thus often forced the player to travel substantial distances to a suitable practice fairway, tennis court, athletic field, ice rink or the like in order to provide a relatively safe facility in which to engage in a practice session. In view of decreasing world fuel supplies and the presently repaidly increasing costs thereof, travel for purposes of engaging in the practice of a sport has become ever more difficult to justify in terms of the energy consumption, cost and time involved. This is particularly so in respect of amateur sportsmen whose livelihoods do not seriously depend upon the competency with which they prosecute their chosen avocational sports. In accordance with the present invention, however, there is provided an effective practice device for sports of the foregoing types, which device requires only a fraction of the space normally required for safe operations and which device can generally be utilized at home or indoors, such as at a gym, rather than at a formal practice site for the particular sport under consideration.

SUMMARY OF THE INVENTION

In accordance with the invention there is provided a practice device comprising an energy-absorbing polymeric foam mat element which is indentable by and slowly recoverable from the impact of a sport projectile thereagainst. A continuous and compliant polymeric sheet element having a smooth exterior surface is disposed over and continuously bounded to at least one face of the foam mat, the exterior surface of said sheet element having indicia thereon defining the target zone of the particular sport being practiced therewith. The device is adapted to be secured to a support surface therefor.

THE DRAWING

FIG. 1 hereof is a front view of one embodiment of the practice device of the invention adapted for baseball pitching practice.

FIG. 2 hereof is a back view of the practice device of FIG. 1 depicting a preferred physical form of the polymeric foam mat element thereof.

FIG. 3 hereof is a partially sectional enlarged side view of a portion of the practice device of FIGS. 1 and 2 depicting one suitable means for securing of the device to a support surface therefor.

FIG. 4 is a front view of another embodiment of the practice device of the invention adapted for ice hockey practice.

DESCRIPTION OF THE PREFERRED EMBODIMENTS

Figure 2:
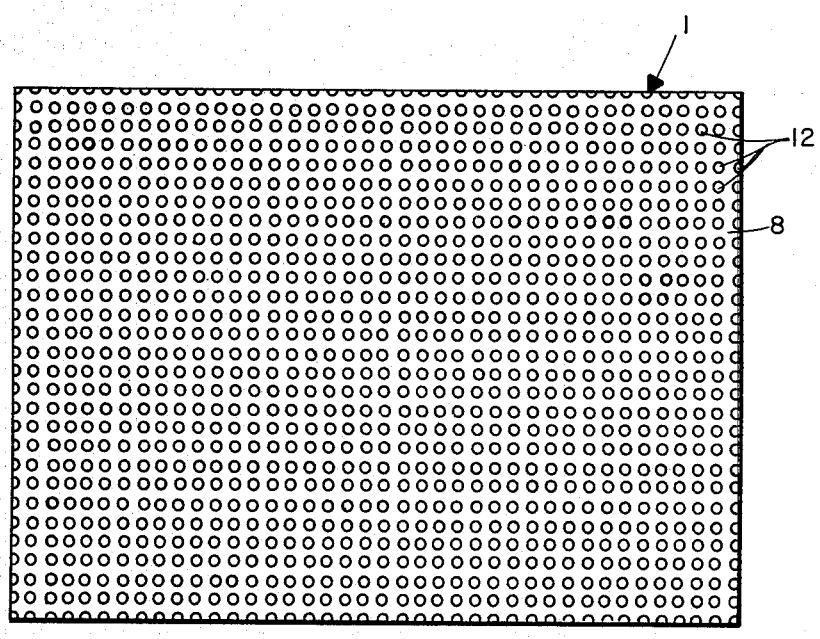
Figure 3:
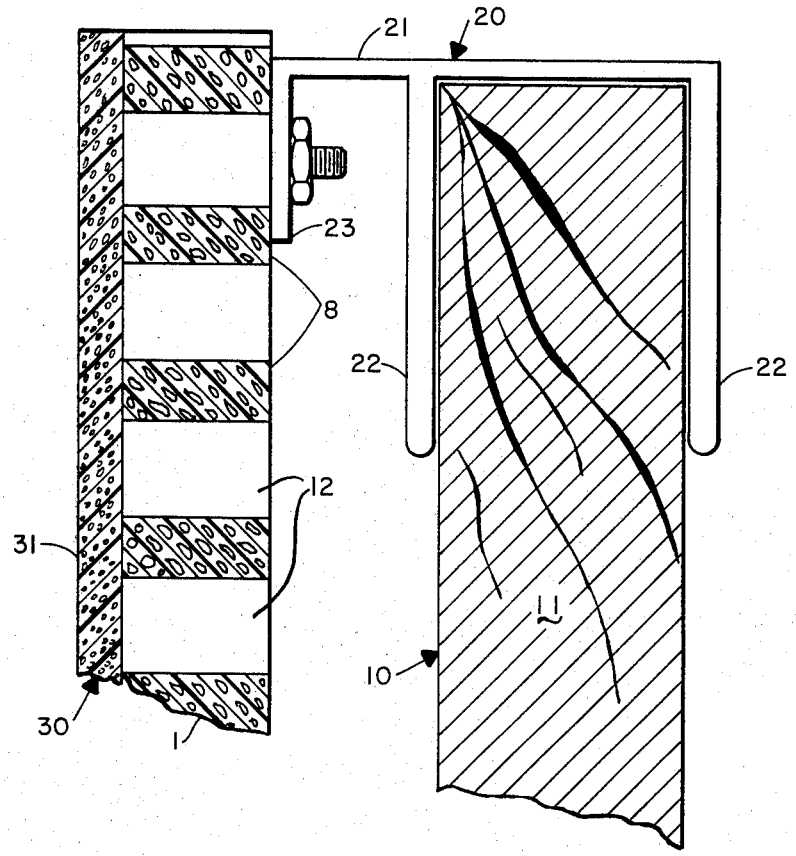
Figure 4:
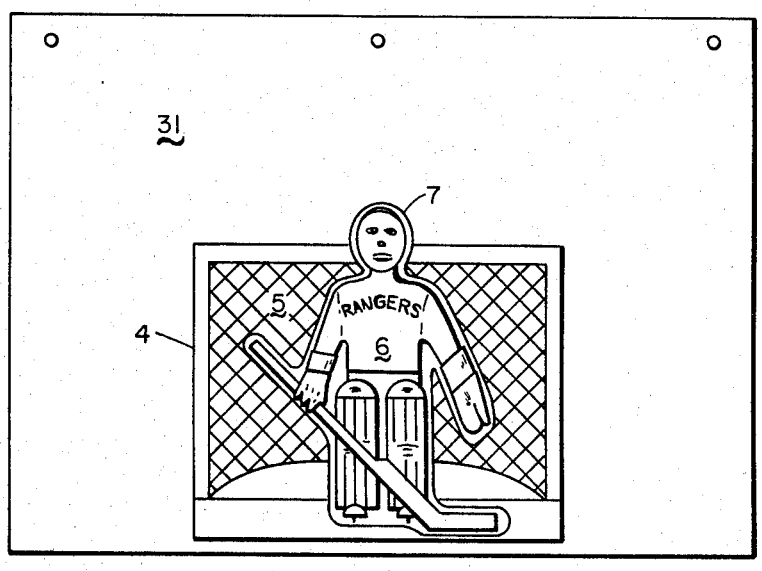

Referring now to FIGS. 1 through 4, inclusive, wherein like reference numerals refer to like structures, the practice device of the invention broadly comprises a mat element 1 composed of an energy absorbing polymeric foam material which is indentable by the impact of a sport projectile thereagainst and which recovers substantially completely, but relatively slowly, from such indentation. Disposed over and continuously bonded to at least one face 2 of said mat element is a continuous and compliant polymeric sheet element 30 having a smooth exterior surface 31. Said surface 31 bears thereon indicia 4 defining a target zone 5 of appropriate size and shape for the particular sport to which the device is directed. In respect of the baseball pitching practice device of FIG. 1 said indicia 4 defines the strike zone. In the case of the ice hockey practice device of FIG. 4, said indicia 4 defines the goal. Where the sport involved is one in which an opposing player is normally present in the vicinity of the target zone 5, such as a batter or hockey goalie, a FIG. 6 representative of such opposing player can also be desirably applied to the exterior surface 31 of polymeric sheet element 30. This, of course, serves to enhance the realism of the practice device and to improve the visual perspective presented thereby. The FIG. 6 can be permanently applied to the surface 31, if desired, such as by printing or painting thereof directly thereon. However, it is normally preferred that said FIG. 6 comprise a separate and distinct cutout 7 composed of a smooth, thin compliant sheet form material which can, if desired, be similar to the polymeric material forming the sheet element 30. Said cutout 7 is removably securable to the exterior surface 31 of the sheet element 30, such as by means of electrostatic attraction, pressure sensitive adhesive or flexible fabric fastening elements. Moreover, it is preferred that the cutout 7 bear representations of the FIG. 6 on both sides thereof. By this preferred construction, the baseball batter depicted in FIG. 1 can be removably secured to the surface 31 of sheet element 30 so as to represent a right-handed batter. On the other hand, if it is desired to practice pitching to a lefthanded batter, it is then merely necessary to (a) strip the cutout 7 from the surface 31, (b) reverse the cutout 7 so as to expose the FIG. 6 appearing on the reverse side thereof and (c) reapply the cutout 7 to the surface 31 on the left side of the target strike zone 5. Similarly, utilizing the embodiment of the invention described above, the FIG. 6 of FIG. 4, representing the hockey goalie, can be repositioned as desired within the goal to simulate various game situations or can be converted to a representation of a left-handed goalie.

Figure 1:
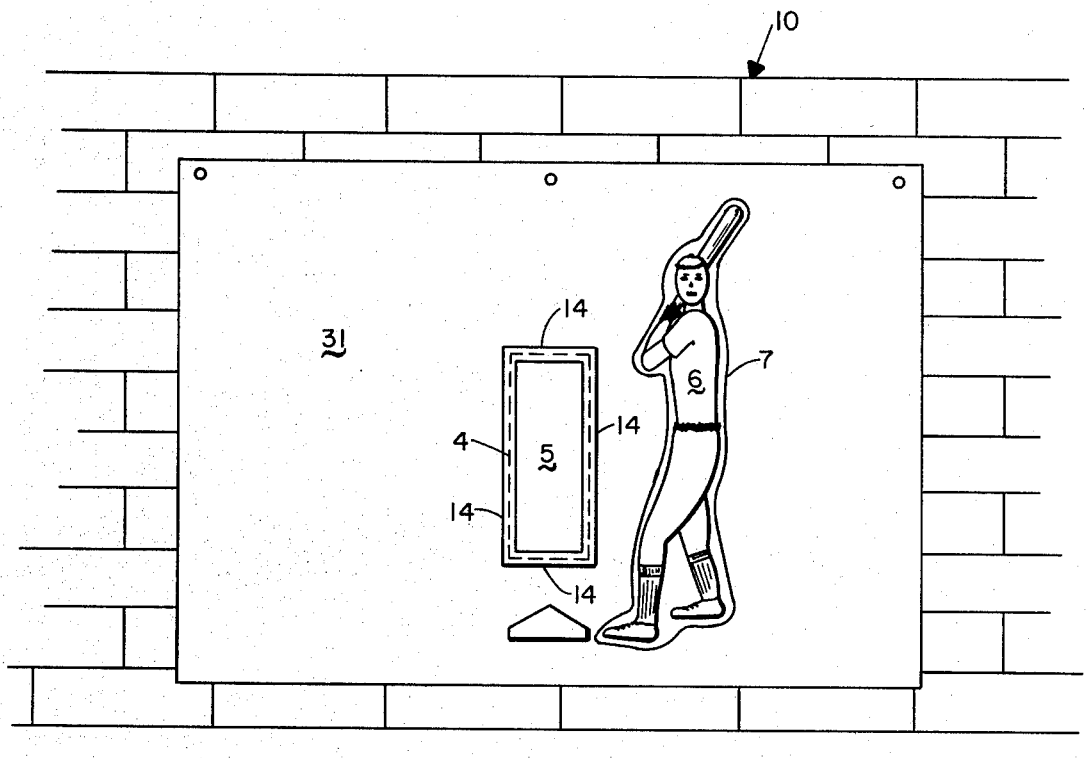

Indicia 4 defining the target zone 5 can be permanently printed or painted upon the smooth exterior surface 31 of sheet element 30 as shown in FIG. 4, or alternatively, can comprise removably securable polymeric tape elements 14 as shown in FIG. 1. Utilizing the latter of these embodiments the dimensions of the target zone 5 can be altered to suit particular purposes. For example, in the baseball pitching practice device of FIG. 1, it can be desirable to provide such alterability of the size of strike zone 5 in order to simulate real game situations wherein opposing batters of different heights and stances are encountered. Where such alterability of the size and/or geometry of the target zone 5 is desired, such may be conveniently provided by use of self-adherent tape as the tape elements 14. Then, when it is desired to alter the size of the strike zone 5, it is only necessary to remove and discard the old tape elements 14, cut new elements 14 of appropriate lengths from a roll of fresh self-adherent tape, and apply the fresh elements 14 to the surface 31 of the polymeric sheet element 30.

The practice device of the invention is adapted to be secured to a support surface 10 therefor, such as a wall or fence. Many suitable means for securing the practice device of the invention to a support surface will be obvious to those of skill in the art. For example, said device can be appropriately secured directly against the support surface by screw fasteners, nails, bolts, rivets, hangers and the like. Generally speaking however, it is preferred that the securing means employed be of a type and size such that the practice device will be suspended at a spaced distance from the support surface 10 of from about one to several inches. In FIG. 3, there is shown one of a plurality of hangers 20 which are secured along the top edge of the practice device by any suitable means and which are of a length sufficient to suspend the device in spaced relationship to the support surface 10. Said hanger 20 may take the form of a section of an extruded metal form comprising a web member 21 having three spaced apart depending members 22, two of which depending members are adapted to engage a wall 11 and the third of which members is secured to the practice device.

In another preferred embodiment of the invention, referring now specifically to FIGS. 2 and 3, the energy absorbing polymeric foam mat element 1 will comprise an array of apertures 12 running completely through the thickness thereof. The diameter of each aperture should be substantial, say at least ¼ inch (0.635 cm) and, while there is no well-defined upper limit, it is obvious that aperture 12 diameters equal to or greater than the least dimension of the sport projectile should be avoided. Moreover, the spacing of said apertures 12 should be such as to define a continuous and substantial web 8 of the polymeric foam material. The aggregate surface area embraced by the array of apertures 12 will preferably reside in the range of from about 40 to about 50 percent of the overall area of mat element 1.

The dimensions of the polymeric foam mat element 1 are subject to considerable variation and are dependent upon such parameters as: the particular sport involved, the contemplated distance of the practice player from the device, the relative expertise of the player to whom the device is directed, the energy absorbing properties of the foam composition employed and the physical form thereof. Obviously, the length and width of the mat element 1 should be sufficient to provide a substantial margin of safety should the player miss the target zone 5 during the course of his practice efforts. For a device of the invention earmarked for use in baseball pitching practice, it has been found that a mat element 1 having a length of at least about six feet (183 cm) and a width of at least about four feet (122 cm) is generally adequate in this regard. The thickness of the mat element 1 should be at least sufficient to provide adequate energy absorbing capability to safely arrest the flight of the sport projectile without substantial rebounding thereof. This minimum thickness, therefore, will be dictated by the energy absorbing properties of the particular polymeric foam composition employed, the physical form thereof and by the nature of the sport. In respect of this last, for instance, the kinetic energy of a well struck hockey puck will obviously be substantially greater than that of a similarly well struck tennis ball. Thus, for a given energy absorbing foam composition of a given physical form, the minimum thickness required of the polymeric foam mat element 1 for an ice hockey practice device will obviously be greater than that required for a tennis practice device. Based upon the foregoing general examplary guidelines, therefore, the required minimum thickness of the mat element 1 for any given set of circumstances can be readily determined in practice.

In terms of the polymeric foam composition employed in the construction of the mat element 1, it is required that said composition (a) be energy absorptive, (b) be visibly indentable under the impact of the sport projectile thereagainst and (c) be slowly, but fully, recoverable from such indentation thereof. The recovery time of the polymeric foam composition, i.e. the time to fully recover from indentation thereof, should be at least about one second and preferably will reside within the range of from about five to about sixty seconds. Observance of these criteria will assure that the player will have adequate opportunity to visually determine the point of impact of the sport projectile relative to the target zone 5. Many open and closed cell polymeric foam compositions are known which possess the above attributes, such compositions being presently widely employed, inter alia, in the fabrication of crash padding for vehicles. Particularly preferred are those foam compositions based upon polymers of vinyl chloride. Such energy absorbing polyvinylchloride foam compositions usually comprise a substantial quantity of one or more external plasticizers and/or flexibilizers compounded therein as to result in a stabilized foam product having the properties required in the practice of the present invention. Exemplary polyvinylchloride foam compositions of general suitability for use in the present invention are, for instance, any of those explicitly disclosed in Canadian Pat. No. 860,386 issued to National Research Corporation on Jan. 5, 1971, and entitled "Energy Absorbing Cellular Material." Various flexible urethane foam compositions are also suitable, specific examples being disclosed, for instance, in U.S. Pat. No. 4,158,087, Louis L. Wood, June 12, 1979, entitled "Urethane Foams Having Low Resiliency."

The basic criteria attending polymeric sheet element 3 are that said element comprise a continuous and compliant polymeric sheet or film having a smooth exterior surface 31. Obviously, sheet element 30 should be sufficiently tough and abrasion resistant as to withstand repetitive impacts thereagainst of the sport projectile. Thus, the sheet material employed as the element 30 can be composed of substantially any polymeric composition meeting these requirements and many specific sheet form polymeric compositions will suggest themselves as suitable to those of skill in the art. Such polymers as butyl, nitrile, EPDM, urethane and butadiene rubbers and homo- and co-polymers of ethylene, propylene and vinyl chloride are all generally suitable polymeric materials of construction for said sheet element 30. Moreover, the polymeric composition can be in a foamed or unfoamed state. In the case of the former of these, of course, the smooth exterior surface 31 will ordinarily, but not necessarily, comprise the skin normally produced at the surface of a polymeric foam during the foaming operation. Flexible polyurethanes and polyvinylchloride based compositions are generally preferred for use as the sheet element 30, particularly when employed in the foamed condition.

As has been previously noted, the sheet element 30 is continuously bonded to the face 2 of the polymeric foam mat element 1. Said bonding can be achieved in any suitable manner such as by means of a suitable adhesive, by thermal welding, solvent welding and the like. Said continuous bonding of the sheet element 30 to the face 2 of the mat element 1 is important since it assures that indentation of the mat element 1 will be fully mimicked by the compliant sheet element 30 and will thus be clearly visible to the player.

In use, the practice device of the invention is first secured to a support surface 10 therefor and the player then attempts to hurl or strike a sport projectile toward the target zone 5. Upon impact against surface 31 of the sheet element 30, the projectile indents said element 30 and the underlying polymeric foam mat element 1 while its flight is safely arrested without substantial rebound thereof. Since the mat element 1 is formed of a polymeric foam material which only slowly recovers fully from indentation thereof, the player is afforded sufficient time to visually observe the position of the indentation of the sheet element 30 relative to the target zone 5. Upon full recovery of the polymeric foam mat element 1, the indentation of the sheet element 30 bonded thereto is "erased", thereby preparing the device for the practice next throw or stroke by the player.

It is obvious that many changes may be made in the above described device without departing from the essential spirit and scope of the invention. Thus, it is intended that the foregoing description and the accompanying drawing be regarded as illustrative of certain preferred embodiments of the invention and not in a limiting sense.

The embodiments of the invention in which an exclusive property or privilege is claimed are defined as follows:

1. A practice device for a sporting activity wherein a sport projectile is hurled or struck toward a specified target zone, said device comprising:

(a) an energy absorbing polymeric foam mat element, said mat element being indentable by and fully but slowly recoverable from the impact of a sport projectile thereagainst;

(b) a continuous and compliant polymeric sheet element having a smooth exterior surface disposed over and bonded continuously to at least one face of said mat element of (a);

(c) indicia defining a target zone on the exterior surface of said sheet element of (b), said indicia being removably secured to the exterior surface of said sheet element of (b), whereby the size and geometry of the target zone defined thereby may be altered.

2. A practice device for a sporting activity wherein a sport projectile is hurled or struck toward a specified target zone, said device comprising:

(a) an energy absorbing polymeric foam mat element, said mat element being indentable by and fully but slowly recoverable from the impact of a sport projectile thereagainst, said mat element being comprised of an array of apertures through the thickness thereof, said apertures each being of a diameter of at least about ¼ inch (0.635 cm), said apertures being spaced apart so as to define a continuous web of polymeric foam, the total surface area of said apertures being, in the aggregate, between about 40 and about 50 percent of the overall surface area of said mat element;

(b) a continuous and compliant polymeric sheet element having a smooth exterior surface disposed over and bonded continuously to at least one face of said mat element of (a);

(c) indicia defining a target zone on the exterior surface of said sheet element of (b).

3. The practice device of claim 2 including a figure representative of an opposing player on the exterior surface of said sheet element of (b).

4. The practice device of claim 3 wherein said figure comprises a cutout formed of a compliant thin polymeric sheet material, said cutout being removably securable to the exterior surface of said sheet element of (b).

5. The practice device of claim 4 wherein said cutout is provided with a representation of said opposing player on each of the two surfaces thereof.

6. The practice device of any of claims 3, 4 or 5 wherein said representation is of a baseball batter and said indicia on the exterior surface of said sheet element of (b) defines a strike zone.

7. The practive device of any of claims 3, 4 or 5 wherein said representation is of a hockey goalie and said indicia on the exterior surface of said sheet element of (b) defines a hockey goal.

8. The practice device of claim 2 or 1 wherein said mat element is composed of a polymer of vinyl chloride.

9. The practice device of claim 2 or 1 wherein said mat element is composed of a flexible polyurethane.

10. The practice device of claim 2 or 1 wherein said polymeric sheet element of (b) comprises a flexible polyurethane or polyvinylchloride foam having an integral skin defining the smooth exterior surface thereof.

11. The practice device of claim 2 or 1 including means to secure said device in spaced apart relationship to a support surface.

12. The practice device of claims 2 or 1 wherein the typical recovery time from indentation caused by the impact of a sport projectile for which said mat element of (a) is designed, is between about 5 and about 60 seconds.

* * * * *